US006665880B2

(12) United States Patent
Poppe

(10) Patent No.: US 6,665,880 B2
(45) Date of Patent: Dec. 23, 2003

(54) PROTECTIVE GARMENTS WITH GLOVE FLAPS

(75) Inventor: Jay A. Poppe, Woodstock, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/001,471

(22) Filed: Nov. 1, 2001

(65) Prior Publication Data

US 2003/0079272 A1 May 1, 2003

(51) Int. Cl.[7] ..... A41B 9/00
(52) U.S. Cl. ..... 2/114; 2/123
(58) Field of Search ..... 2/455, 456, 457, 2/2.11, 2.14, 2.15, 59, 60, 85, 87, 93, 98, 123, 125, 129; 128/849

(56) References Cited

U.S. PATENT DOCUMENTS

| | | | | |
|---|---|---|---|---|
| 3,496,572 A | | 2/1970 | Herzig | |
| 3,921,221 A | | 11/1975 | Zoephel | |
| 4,040,124 A | | 8/1977 | Zoephel | |
| 4,041,203 A | | 8/1977 | Brock et al. | |
| 4,389,734 A | | 6/1983 | Franz et al. | |
| 4,535,481 A | | 8/1985 | Ruth-Larson et al. | |
| 4,543,670 A | * | 10/1985 | Ehring | 2/124 |
| 4,631,753 A | * | 12/1986 | Ehring | 2/124 |
| 4,947,868 A | | 8/1990 | Schoolman | |
| 5,033,115 A | | 7/1991 | Bowling et al. | |
| 5,073,988 A | * | 12/1991 | Lewis et al. | 2/123 |
| 5,097,534 A | | 3/1992 | Viemeister et al. | |
| 5,142,704 A | * | 9/1992 | Viemeister et al. | 2/202 |
| 5,414,867 A | * | 5/1995 | Bowling et al. | 2/114 |
| 5,444,871 A | | 8/1995 | Lopez | |
| 5,461,724 A | | 10/1995 | Wiedner et al. | |
| 5,572,743 A | | 11/1996 | Yavitz | |
| 5,588,155 A | | 12/1996 | Baker et al. | |
| 5,594,955 A | | 1/1997 | Sommers | |
| 5,628,067 A | | 5/1997 | Meyer et al. | |
| 5,680,653 A | | 10/1997 | Mathis et al. | |
| 5,693,401 A | | 12/1997 | Sommers et al. | |
| 5,705,251 A | | 1/1998 | Morman et al. | |
| 5,724,674 A | | 3/1998 | Covington et al. | |
| 5,734,992 A | | 4/1998 | Ross | |
| 5,816,440 A | | 10/1998 | Shields et al. | |
| 5,924,130 A | | 7/1999 | Fragomeli | |
| 5,948,707 A | | 9/1999 | Crawley et al. | |
| 6,115,839 A | | 9/2000 | Covington et al. | |
| 6,134,717 A | | 10/2000 | Grilliot et al. | |
| 6,235,659 B1 | | 5/2001 | McAmish et al. | |

FOREIGN PATENT DOCUMENTS

| | | |
|---|---|---|
| EP | 0507607 A1 | 10/1992 |
| FR | 2 606 604 A1 | 5/1988 |

* cited by examiner

*Primary Examiner*—Gary L. Welch
(74) *Attorney, Agent, or Firm*—Scott B. Garrison

(57) ABSTRACT

A sleeve for use in protective garments, the sleeve including a lower edge, an upper edge, and a glove flap. The glove flap may include an upper edge and a positioning feature, the glove flap being disposed between the upper edge of the sleeve and the lower edge of the sleeve, the positioning feature being disposed proximate to the upper edge of the glove flap, the glove flap having sufficient length so that at least a portion of the glove flap may be positioned below the lower edge of the sleeve, the positioning feature adapted to retain the glove flap in such position.

19 Claims, 6 Drawing Sheets

PROTECTIVE GARMENTS WITH GLOVE FLAPS

The present invention relates generally to protective garments for use with gloves.

There are many types of limited use or disposable protective garments and apparel designed to provide barrier properties, including surgical gowns and protective coveralls. Such protective garments are used in situations where isolation of a wearer from a particular environment is desirable, or it is desirable to inhibit or retard the passage of hazardous liquids and biological contaminates through the garment to the wearer.

In surgical procedure environments, such liquids may include patient liquids such as blood, salvia, perspiration and life support liquids such as plasma and saline. Protective garments rely on the barrier properties of the fabrics used in the garment, and on the construction and design of the garment. Openings or seams in some types of protective garments may be unsatisfactory, especially if the seams are located in positions where they may be subjected to stress and/or direct contact with hazardous substances.

Wearers of protective garments frequently don gloves to extend the protective barrier between the wearer and the environment. The interface between the glove and the protective garment can be an area of concern when evaluating the potential for exposure of the wearer to the hazards of the environment. In some instances, the hazardous substances contact the upper portion of the garment sleeves and flow downward toward the garment-glove interface. In such environments, the garment-glove interface can provide an opening through which hazardous substances can come into contact with the wearer. Additionally, the garment-glove interface is frequently subjected to movement and is likely to be in direct contact with or in the flow path of hazardous substances.

Additionally, glove slippage or roll-down occurs if the frictional interface between the interior of the glove surface and the sleeve or cuff exterior surface is insufficient to maintain the glove in an appropriate position.

Some protective garments include a cuff positioned at the end of the sleeve. Such cuffs may be constructed in a variety of ways and may be formed from liquid repellent or liquid retentive materials. In some garments, the garment cuffs may be formed from an elastic material. The elastic material may include a variety of fabrics. Examples of such fabrics include cotton, knits and polyester knits.

In some situations, the glove may be sized to overlap the cuff and a portion of the sleeve to provide additional protection to the wearer at the garment-glove interface. When the cuff is formed from liquid retentive fabrics and a glove is placed over the cuff, perspiration formed within the gown sleeve may collect in the cuffs. As the amount of perspiration retained in the cuff increases, the liquid may migrate to the garment-glove interface. The wearer's hand and arm movements may assist in moving the retained perspiration toward the garment-glove interface. Strike-through of hazardous liquids may then occur when liquids generated by the environment contact the wearer's perspiration in the area of the sleeve and cuff.

Various embodiments of the present invention relate to a protective garment that may be used in medical environments. The garment may include a garment body, a neck portion and two sleeves attached to the garment body. Each sleeve may include a lower edge and an upper edge.

At least one of the sleeves may also include a glove flap that is disposed above the lower edge of the sleeve. The glove flap may have an upper edge. The glove flap may have sufficient length so that the upper edge of the glove flap may be positioned below the lower edge of the sleeve.

Such a sleeve may also include a positioning feature that may be disposed between the upper edge of the sleeve and the lower edge of the sleeve and may, in some embodiments, define the upper edge of the glove flap. The positioning feature may be configured to retain the glove flap in place when the glove flap has been positioned below the lower edge of the sleeve.

In some embodiments, a cuff may be attached to the lower edge of the sleeve.

Figure 1:
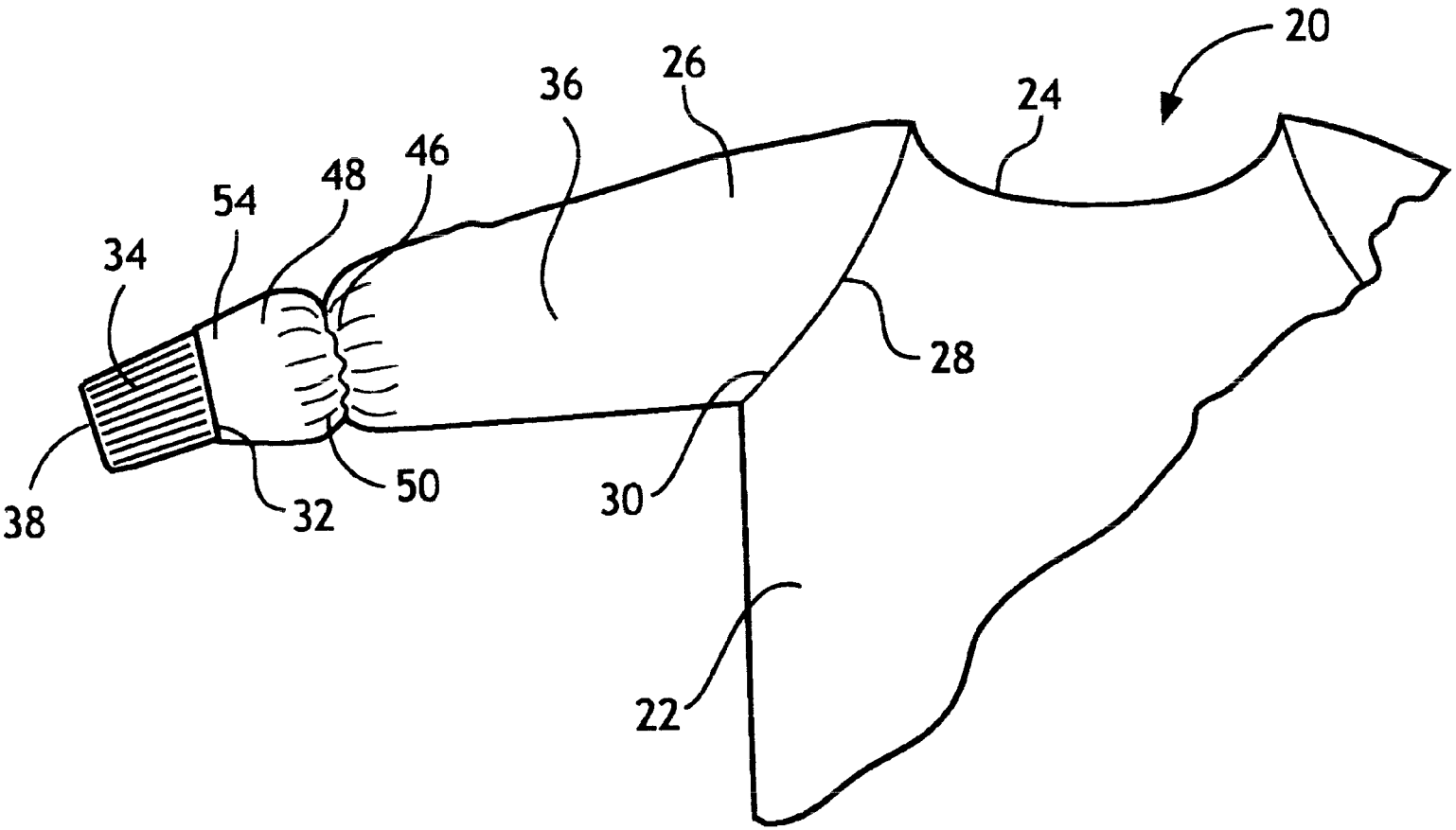
FIG. 1 is a partial broken-away side view of an embodiment of a protective garment according to the present invention.

As shown in FIG. 1, the present invention relates to a protective garment 20. Such a protective garment 20 has wide application and, while the invention may useful in medical applications, the invention can be used in any instance where a protective garment such as a coverall, robe, gown, etc. is used.

The garment 20 may include a gown body 22 and a neck portion 24. The garment 20 may further include two sleeves, such as sleeve 26 that is attached to the gown body 22 at a seam 28. Each sleeve 26 may include an upper edge 30, a lower edge 32 and an exterior surface 36. As used herein, the term 'lower' is generally used to denote features or a direction that is closer to the hand of the wearer. Similarly, the term 'upper' is generally used to denote features or a direction that is closer to the shoulder of the wearer.

Figure 2:
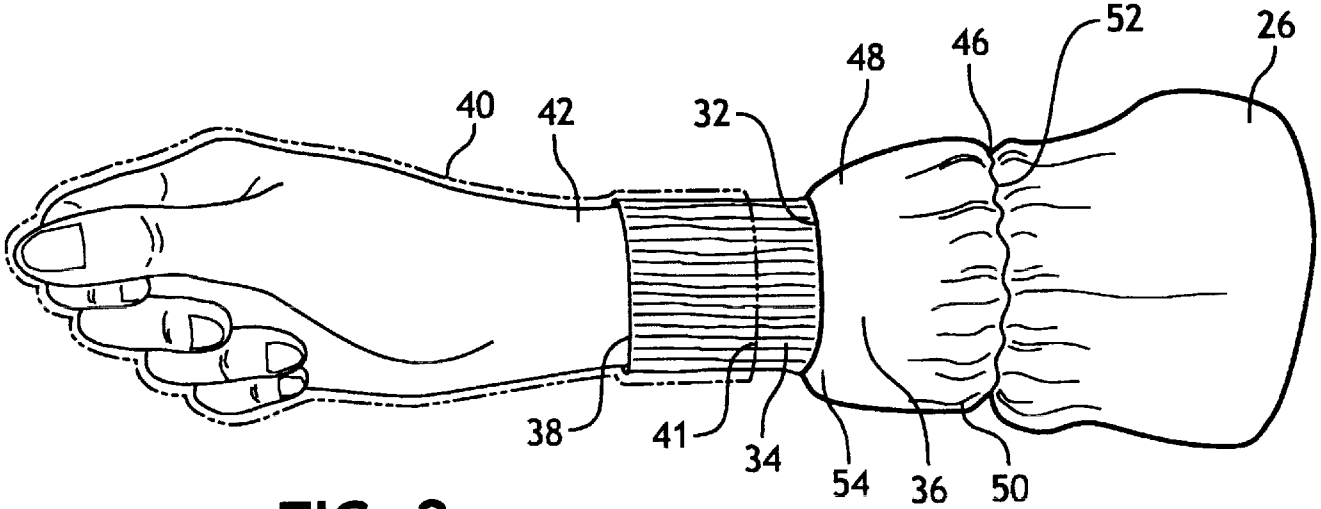
FIG. 2 is a partial perspective view of an embodiment of the present invention.

In some embodiments and as shown in FIGS. 1 and 2, a cuff 34 may be attached to the lower edge 32 of the sleeve 26. Cuffs useful in the present invention may be formed from a variety of materials and may have numerous different configurations. For example, short, tight-fitting cuffs made from a knitted material may be used with the present invention. Such knitted cuffs may be formed with or without ribs. Cuffs suitable for use with the garments according to the present invention are described in U.S. Pat. Nos. 5,594,955 and 5,680,653, both of which are incorporated herein in their entirety for all purposes.

As shown in FIGS. 1 and 2, at least one of the sleeves 26 may also include a glove flap 48. The glove flap 48 is disposed between the shoulder seam 28 and the lower edge 32 of the sleeve 26. The glove flap 48 includes an upper portion 50 and a lower portion 54. In some embodiments, the lower portion 54 is adjacent to the lower edge 32 of the sleeve 26. The glove flap 48 also includes a positioning feature 46 that may be disposed between the upper edge 30 of the sleeve 26 and the lower edge 32 of the sleeve 26. The positioning feature 46 may be positioned above or below the upper edge 50 of the glove flap 48.

Figure 5:
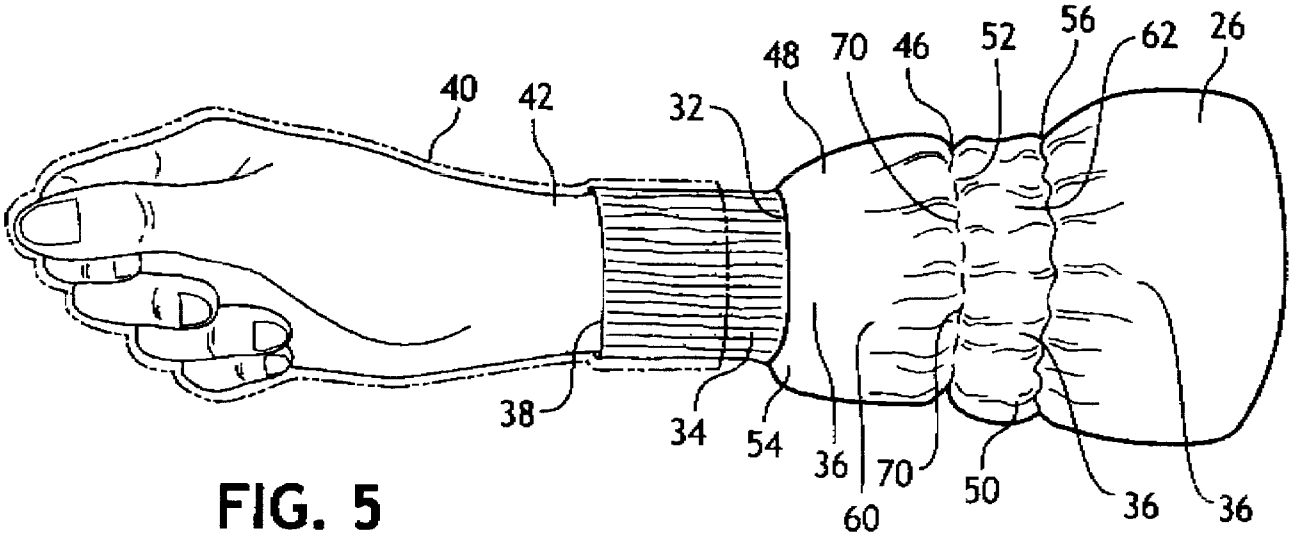
FIG. 5 is a partial perspective view of an another embodiment of the present invention.

As shown in FIGS. 1 and 5, the positioning feature 46 may take on many different configurations. For example, the positioning feature 46 may be continuous around the sleeve 26, (see FIG. 1), or may be discontinuous around the sleeve 26, such as short segments 70 that are disposed at varying intervals (see FIG. 5).

Many different types of materials may be utilized in the protective garment 20 and sleeves 26 of the present invention. Such materials may be reusable or disposable. For example, materials such as nonwovens, wovens, films, film/foam laminates and combinations of such and like materials may be used in the present invention. A particular material that is suitable for use with the present invention is a three-layer nonwoven polypropylene material that is commonly referred to as "SMS", which is a spunbond-meltblown-spunbond laminate. Such a material is described in U.S. Pat. No. 4,041,203 to Brock et al.

Figure 3:
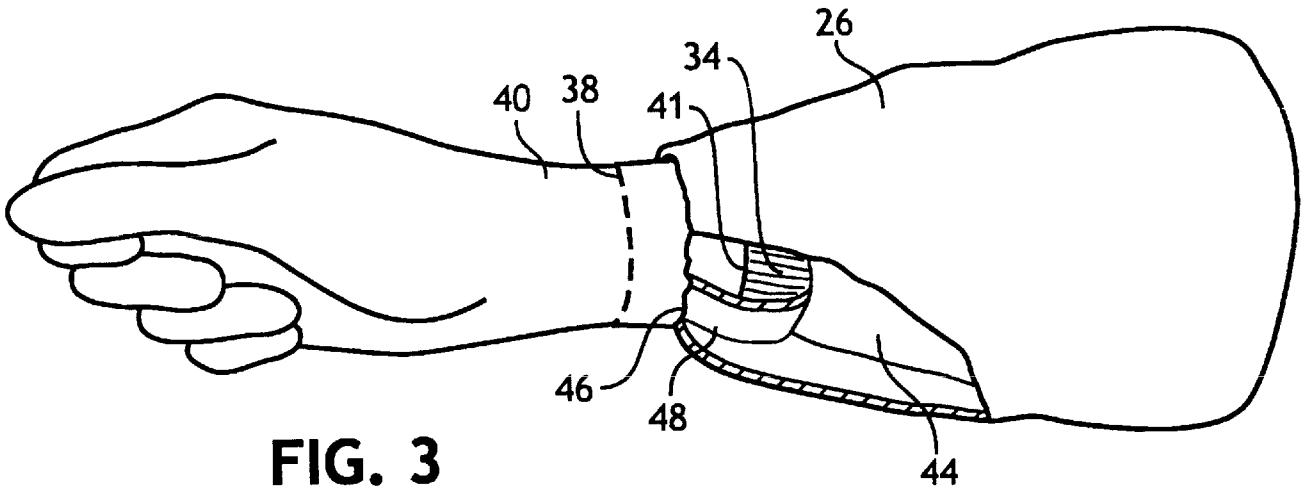
FIG. 3 is a partial perspective view of the embodiment of the present invention that is depicted in FIG. 2, illustrating the glove flap positioned over a glove.

As shown in FIGS. 2 and 3, protective garments are frequently used with gloves such as glove 40 that is placed over the hand 42 of a wearer. As shown in FIG. 2, the glove edge 41 is frequently positioned over the cuff 34 of the protective garment 20 to inhibit the entry of undesirable material between the glove-sleeve interface.

As shown in FIG. 3, the glove flap 48 may have a sufficient length, as measured from the upper portion 50 to the lower portion 54, so that at least a portion of the glove flap 48 may be positioned below the lower edge 32 of the sleeve 26 and below and over the glove edge 41. The positioning of the glove flap 48 in this manner further assists in inhibiting the entry of undesirable material between the glove-sleeve interface.

Figure 4:
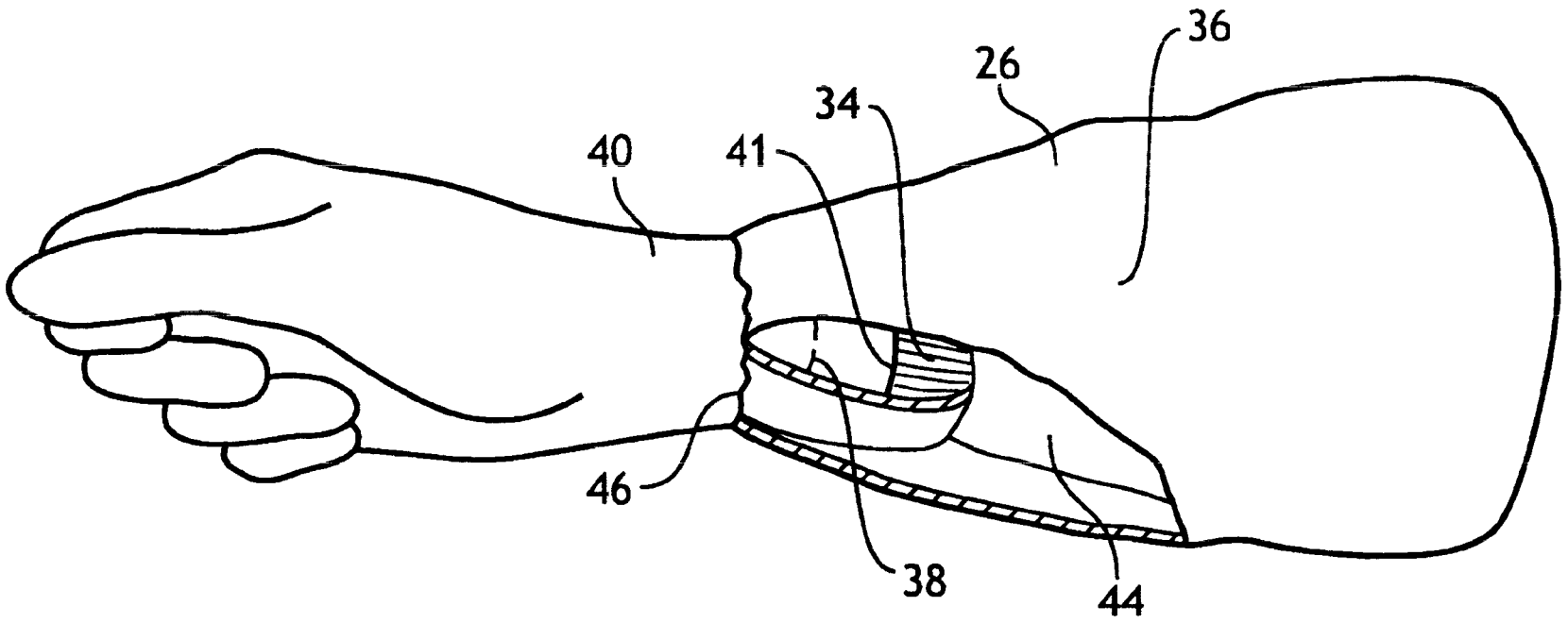
FIG. 4 is a partial broken-away perspective view of the embodiment of the present invention that is depicted in FIG. 2, illustrating the glove flap positioned over a glove and positioned past the end of the sleeve cuff.

As shown in FIG. 4, the glove flap 48 may be moved to a position so that the glove flap 48 extends over and below the glove edge 41 of the glove 40 and also positioned over and below the end 38 of the cuff 34. In such an embodiment, the positioning feature 46 may be assisted in retaining the glove flap 48 in an appropriate position by the ridge formed under the glove 40 by the end 38 of the cuff 34.

The positioning feature 46 enables the glove flap 48 to be retained in the positions that are depicted in FIGS. 3 and 4. The positioning feature 46 may be variously formed and may, as shown in FIGS. 1–3, be formed as an elastic member. Such an elastic member 52 may be variously applied to the sleeve 26. For example, the elastic member 52 may be extruded directly onto the interior or exterior surfaces of the sleeve 26. In some embodiments, the member 52 may be disposed on the sleeve 26 and, in a subsequent process such as, for example, heating, the member 52 may become elasticized.

In selected embodiments, the elastic member 52 may be formed from an elasticized tape that is glued or otherwise adhered to the sleeve 26. If desired, the elastic member may be sewn to the sleeve 26. In such an embodiment, the seam may be sealed in a subsequent operation to prevent hazardous liquids from passing through the holes formed in the sleeve 26 by the seam.

Figure 6:
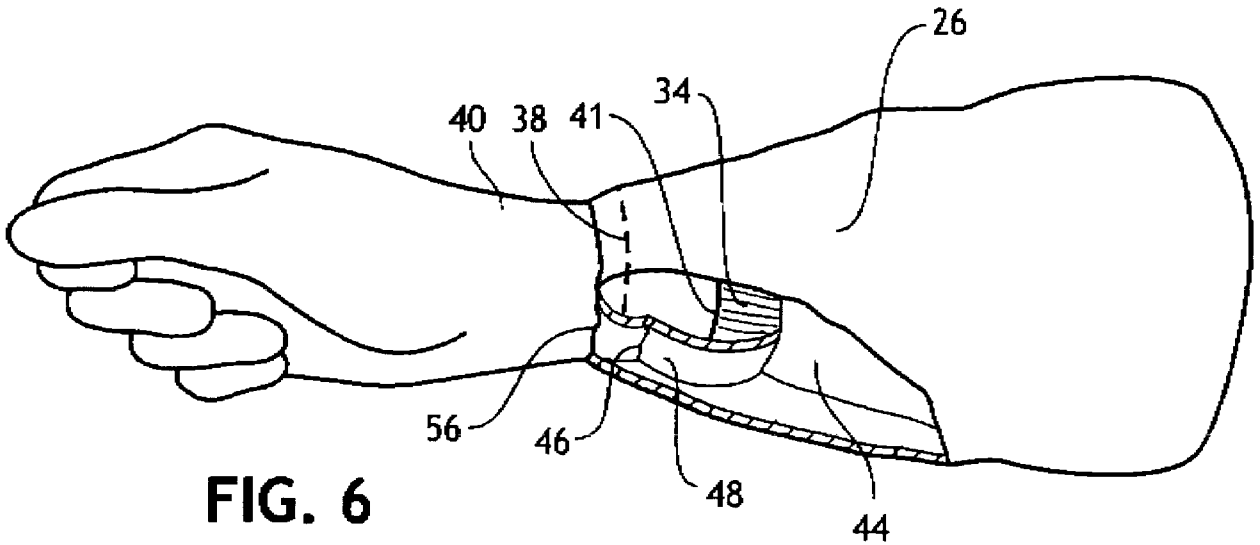
FIG. 6 is a partial broken-away perspective view of the embodiment that is depicted in FIG. 5, illustrating the glove flap positioned over a glove.

In particular embodiments, two or more positioning features may be utilized to decrease the potential for hazardous liquids to pass between the glove-cuff interface. As shown in FIGS. 5 and 6, the sleeve 26 may include a glove flap 48 having a positioning feature 46 and an additional positioning feature 56. In selected embodiments, the additional positioning feature 56 may be disposed above the positioning feature 46. The positioning features 46 and 56 may have similar or different configurations, depending upon the needs of the garment 20. As shown in FIG. 6, the glove flap 48 may be positioned so that the positioning member 46 is disposed below the edge 41 of the glove 40. As also seen in FIG. 6, the positioning member 56 may be disposed below the edge 38 of the cuff 34.

Figure 7:
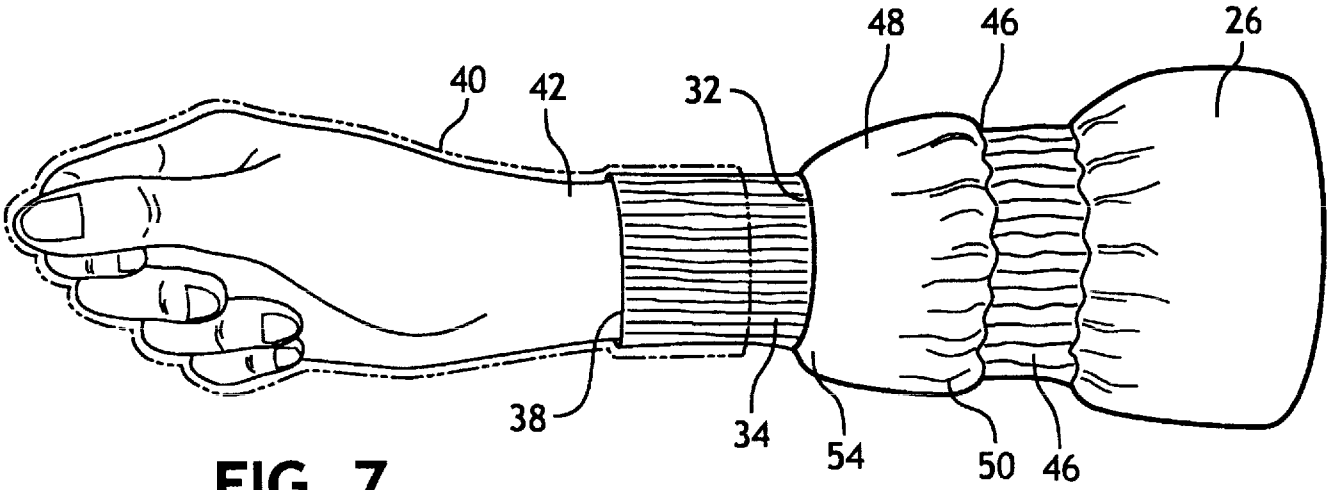
FIG. 7 is a partial perspective view of yet another embodiment of the present invention.
Figure 8:
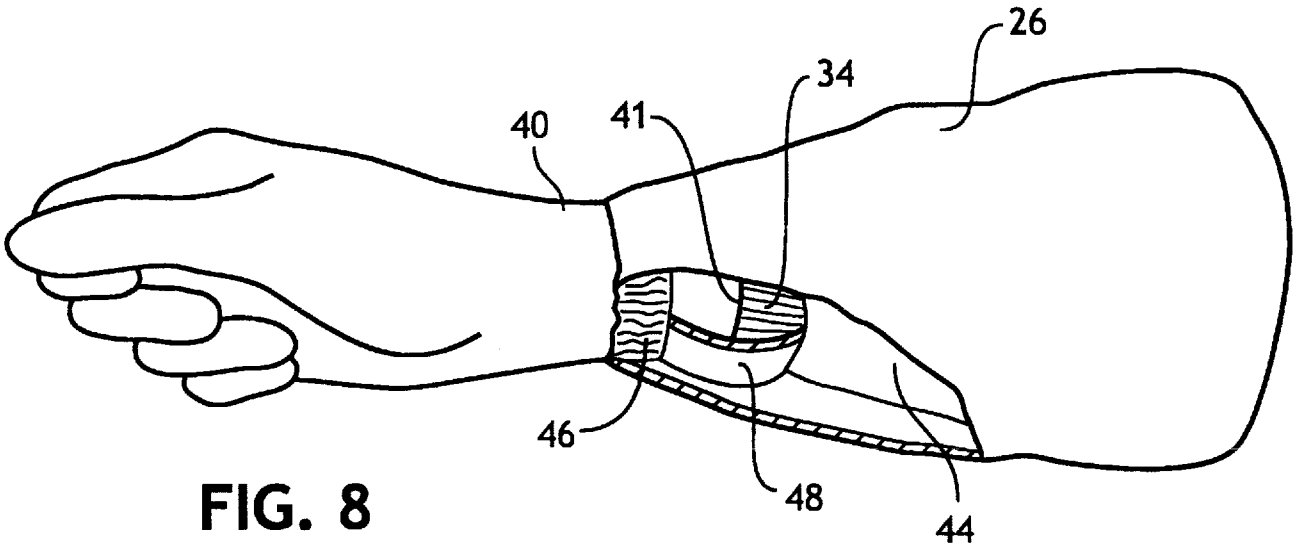
FIG. 8 is a partial broken-away perspective view of the embodiment that is depicted in FIG. 7, illustrating the glove flap positioned over a glove and positioned past the end of the sleeve cuff.

Referring now to FIGS. 7 and 8, the positioning member 46 may be configured as a band that has a relatively substantial width. A large variety of widths may be used in the positioning members 46 of the present invention. When such a positioning member 46 is positioned below the edge 38 of the cuff 34, the width of the positioning member further assists in retaining the positioning member 46 below the cuff 34. A relatively wide positioning member 46 further decreases the opportunities for fluids to pass beyond the positioning member. These features increase the likelihood that the glove flap 48 will inhibit the passing of hazardous fluids through to the glove-cuff interface.

The positioning member 46 may, in some embodiments, gather the material of the sleeve 26 toward the wearer's arm 44 so that, when the positioning member 46 is positioned below the garment-glove interface, the positioning member 46 conforms to the wearer's hand or wrist.

Figure 9:
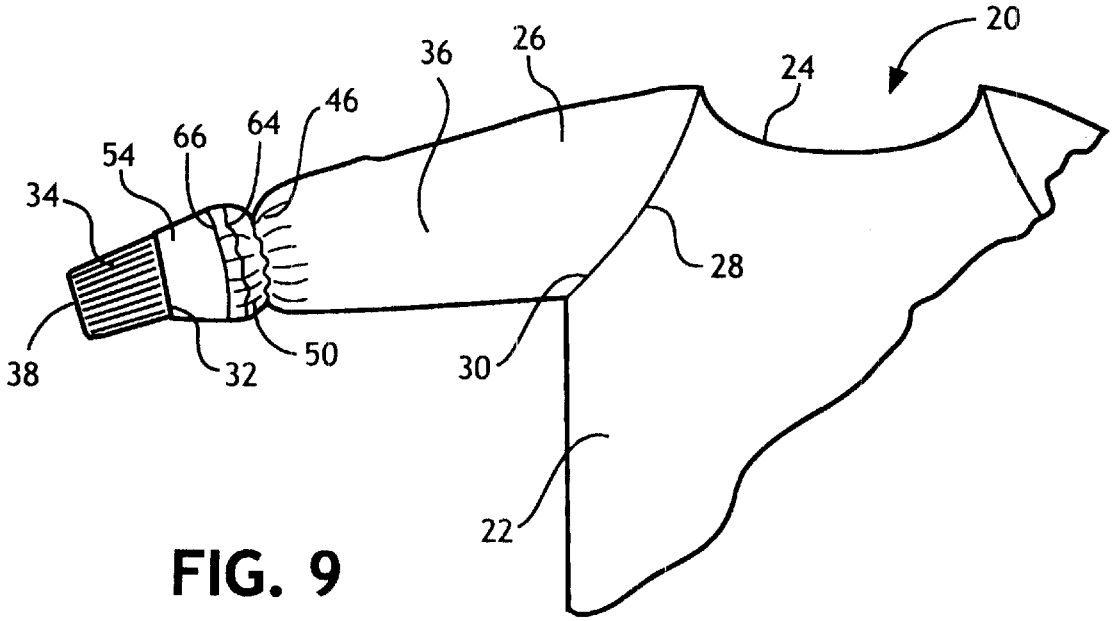
FIG. 9 is a partial side view of an alternate embodiment of a protective garment according to the present invention.

In some embodiments, the surface 36 of the sleeve 26 may be modified to assist in retaining the glove flap 48 over the end of the glove 40. As shown in FIGS. 5 and 9, a surface modifier may be applied to the surface 36 of the sleeve 26 to enhance the tackiness of the sleeve 26. Enhancing the tackiness of the surface of the sleeve 26 increases the likelihood that the glove flap 48 will be retained in the desired position. A variety of surface modifiers may be used in the present invention, such as, for example, ethylene vinyl acetate copolymers, sytrene-butadiene, cellulose acetate butyrate, ethyl cellulose, synthetic rubbers including, for example, Krayton™ block copolymers, natural rubber, polyethylenes, polyamides, flexible polyolefins, and amorphous polyalphaolefins. These materials may be applied to the garment in a variety of ways, such as, for example, melt spraying, slot coating and printing.

Figure 10:
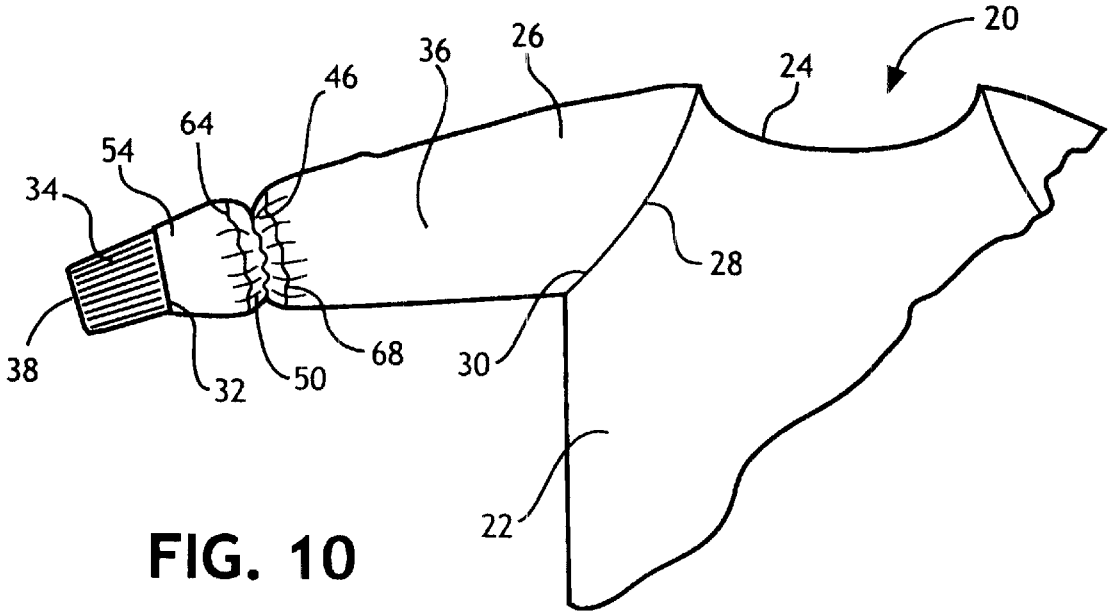
FIG. 10 is a partial side view of another alternate embodiment of a protective garment according to the present invention.

For example and as shown in FIG. 5, a surface modifier, such as those described above and similar compositions, may be positioned on the sleeve 26 in areas 60 and 62. As seen in FIG. 5, the area 60 is disposed below the positioning member 46 and the area 62 is disposed below the positioning member 56. Referring now to FIG. 9, two ridges 64 and 66 may be positioned on the sleeve 26 below the positioning member 46. In such an embodiment, the tackiness and height of the ridges may assist in retaining the glove flap 48 in its desired position as the ridges 64 and 66 inhibit movement of the glove flap 48 upward to a position that is above the glove-sleeve interface. As shown in FIG. 10, a ridge 68 may be positioned above the positioning member 46 and may, in some embodiments and as shown in FIG. 10, be used with a ridge 64. Any of a variety of configurations of such surface modifying elements may be used in the present invention.

The invention may be embodied in other specific forms without departing from the scope and spirit of the inventive characteristics thereof. The present embodiments therefore are to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A single piece protective garment comprising:

a body;

a neck portion;

two sleeves attached to the body, each sleeve comprising a lower edge and an upper edge, at least one of the sleeves comprising a positioning feature integrated with the sleeve and disposed between the upper edge of the sleeve and the lower edge of the sleeve, a glove flap formed from and comprising part of the sleeve disposed between the positioning feature and the lower edge of the sleeve, the glove flap being of sufficient length so that the positioning feature may be positioned so that the glove flap overlays the lower edge of the sleeve; and a cuff attached to the lower edge of the sleeve.

2. The protective garment as claimed in claim 1, the positioning feature comprising an elastic member.

3. The protective garment as claimed in claim 1, the protective garment comprising a surgical gown.

4. The protective garment as claimed in claim 1, further comprising an additional positioning feature formed from and comprising part of the sleeve.

5. The protective garment as claimed in claim 1, the sleeve further comprising a surface modifier adapted to enhance the tackiness of at least a portion of the sleeve.

6. The protective garment as claimed in claim 5, the surface modifier being formed as a ridge.

7. The protective garment as claimed in claim 5, the surface modifier being applied to an area adjacent to the positioning member.

8. A single piece surgical gown comprising:

a gown body; and two sleeves, each sleeve attached to the gown body, at least one sleeve comprising a lower edge, and a glove flap having an upper edge, the glove flap formed from and comprising part of the sleeve being disposed above the lower edge of the sleeve, the glove flap having sufficient length so that the upper edge of the glove flap may be positioned below the lower edge of the sleeve, and at least one positioning feature integrated with the sleeve and disposed above the upper edge of the glove flap.

9. The surgical gown as claimed in claim 8, the positioning feature comprising an elastic member.

10. The surgical gown as claimed in claim 8, further comprising two positioning features, each integrated with the sleeve.

11. The surgical gown as claimed in claim 8, the sleeve further comprising a surface modifier adapted to enhance the tackiness of at least a portion of the sleeve.

12. The surgical gown as claimed in claim 11, the surface modifier being formed as a ridge.

13. The surgical gown as claimed in claim 11, the surface modifier being applied to an area adjacent to the upper edge of the glove flap.

14. The surgical gown as claimed in claim 11, the surface modifier being applied to an area adjacent to the lower edge of the glove flap.

15. A sleeve for use in protective garments, the sleeve comprising:

a lower edge;

an upper edge; and a glove flap disposed between the upper edge of the sleeve and the lower edge of the sleeve, the glove flap having an upper edge and a positioning feature integrated with the sleeve, the positioning feature being disposed proximate to the upper edge of the glove flap, the glove flap having sufficient length so that at least a portion of the glove flap may be positioned below the lower edge of the sleeve, the positioning feature adapted to retain the glove flap in such position.

16. The sleeve as claimed in claim 15, further comprising at least one positioning feature integrated with the sleeve disposed above the upper edge of the glove flap.

17. The sleeve as claimed in claim 16, the positioning feature comprising an elastic member.

18. The sleeve as claimed in claim 15, further comprising two positioning features, each integrated with the sleeve.

19. The sleeve as claimed in claim 11, the sleeve further comprising a surface modifier adapted to enhance the tackiness of at least a portion of the sleeve.

* * * * *